US008302652B2

(12) United States Patent
Hirsh et al.

(10) Patent No.: US 8,302,652 B2
(45) Date of Patent: Nov. 6, 2012

(54) DECORATIVE SHUTTER COVER KIT

(75) Inventors: Stephen Lee Hirsh, South Euclid, OH (US); Mary Carlisle Clements Puro, Aurora, OH (US)

(73) Assignee: The Original Shutter Cover Company Ltd., South Euclid, OH (US)

( * ) Notice: Subject to any disclaimer, the term of this patent is extended or adjusted under 35 U.S.C. 154(b) by 377 days.

(21) Appl. No.: 12/113,696

(22) Filed: May 1, 2008

(65) Prior Publication Data

US 2008/0271855 A1 Nov. 6, 2008

Related U.S. Application Data

(60) Provisional application No. 60/915,225, filed on May 1, 2007.

(51) Int. Cl.
*A47H 1/00* (2006.01)
*A47H 13/01* (2006.01)
*E06B 3/80* (2006.01)

(52) U.S. Cl. ..... 160/90; 160/368.1; 160/327; 160/402

(58) Field of Classification Search ..... 160/89, 160/90, 106, 327, 349.1, 368.1, 399, 402, 160/10, 371, 380; 52/202, 203, 473; 40/603
See application file for complete search history.

(56) References Cited

U.S. PATENT DOCUMENTS 2,629,432 A * 2/1953 Hanslick ..... 160/402
2,792,612 A * 5/1957 Wickliffe ..... 24/530
2,878,536 A * 3/1959 Becker ..... 52/202
3,089,211 A * 5/1963 Perusse ..... 24/556
3,205,118 A * 9/1965 Guffan ..... 160/238
3,214,879 A * 11/1965 Ellingson, Jr. et al. ..... 52/393
3,913,655 A * 10/1975 Ogino ..... 160/84.01
3,996,987 A * 12/1976 Rodriguez ..... 160/19
4,146,999 A * 4/1979 Petrovec et al. ..... 52/145
RE29,979 E 5/1979 Guebert et al.
4,221,091 A * 9/1980 Ganse et al. ..... 52/202
4,221,255 A * 9/1980 Barkemeyer ..... 160/197
4,272,934 A * 6/1981 Cowden et al. ..... 52/202
4,416,096 A * 11/1983 Schuster et al. ..... 52/202
4,454,691 A * 6/1984 Mitchell ..... 52/202
4,486,990 A * 12/1984 Bauch ..... 52/202
4,658,522 A * 4/1987 Kramer ..... 38/102.91
4,708,183 A * 11/1987 Figueroa ..... 108/90
4,867,222 A * 9/1989 Roman et al. ..... 160/89
5,010,944 A 4/1991 Bussert (Continued)

OTHER PUBLICATIONS

International Search Report dated Aug. 26, 2008.

*Primary Examiner* — Blair M Johnson
*Assistant Examiner* — Jaime F Cardenas-Garcia
(74) *Attorney, Agent, or Firm* — Fay Sharpe LLP; Richard M. Klein

(57) ABSTRACT

A kit for attaching a decorative shutter cover to an associated window shutter is disclosed. The kit comprises a shutter cover which covers a portion or a substantial portion of the window shutter. The kit may further include an attachment member that attaches to the top of the window shutter. The top of the shutter cover and the attachment member can connect to each other. The kit may further comprise a securing member for securing the bottom of the shutter cover to the window shutter. The shutter cover may include a graphic display thereon, such as decorative or artistic representations. Additional interchangeable shutter covers may also be provided with the same or different graphic displays depicted thereon.

7 Claims, 11 Drawing Sheets

U.S. PATENT DOCUMENTS 5,024,015 A * 6/1991 Quarles, Jr. ..... 40/605
5,042,551 A * 8/1991 Ein et al. ..... 160/90
5,109,912 A * 5/1992 Gary ..... 160/330
5,191,922 A * 3/1993 Wade ..... 160/124
5,231,739 A * 8/1993 Mattesky ..... 24/556
5,570,490 A * 11/1996 Walsh et al. ..... 16/87.4 R
5,634,741 A * 6/1997 Tremblay et al. ..... 405/43
5,673,741 A 10/1997 Cairns
5,894,642 A * 4/1999 Eberhardt ..... 24/716
5,915,442 A * 6/1999 Prosch ..... 160/84.01
6,065,258 A * 5/2000 McClatchy ..... 52/238.1
6,269,597 B1 * 8/2001 Haas ..... 52/203
6,381,812 B1 * 5/2002 Crider et al. ..... 24/306
6,422,797 B2 * 7/2002 Pas ..... 412/33
6,672,366 B1 * 1/2004 Wade et al. ..... 160/371
6,675,860 B2 * 1/2004 Steele ..... 160/90
6,732,783 B2 * 5/2004 Bouldin ..... 160/348
6,915,604 B2 7/2005 Haywood
6,945,533 B1 * 9/2005 Salerno ..... 273/309
7,165,596 B1 * 1/2007 Helton ..... 160/222
7,219,405 B1 * 5/2007 Nevens ..... 24/464
7,293,596 B2 * 11/2007 Nien ..... 160/89
D600,542 S * 9/2009 Zemel ..... D8/395
7,650,924 B1 * 1/2010 Bouldin ..... 160/330
7,743,813 B2 * 6/2010 Haffamier et al. ..... 160/39
2003/0047294 A1 * 3/2003 Fritsche et al. ..... 160/327
2004/0187417 A1 * 9/2004 Thomas ..... 52/311.1
2004/0261959 A1 * 12/2004 Forcelli ..... 160/368.1
2005/0150616 A1 * 7/2005 McConnell et al. ..... 160/368.1
2006/0207728 A1 * 9/2006 Lin ..... 160/38

* cited by examiner

DECORATIVE SHUTTER COVER KIT

CROSS-REFERENCE TO RELATED APPLICATIONS

This application claims priority to U.S. Provisional Patent Application Ser. No. 60/915,225, filed May 1, 2007, which is hereby fully incorporated by reference herein.

BACKGROUND

The present disclosure relates to a shutter cover kit. The kit is useful for changing the decorative appearance of window shutters and/or building structures have such shutters.

Window shutters are generally rectangular platforms that are present on one or more sides of a window. They can be swiveled to cover or protect a window, such as against an approaching storm, to shield out sunlight, etc. In other embodiments, the shutters can be stationary and are present mainly for ornamental purposes. Window shutters are usually made of wood, fiberglass, metal, or composite materials, and usually have a single color. The appearance of the window shutter generally does not change except for aging or when a new coating of paint, stain, etc. is applied.

The size of window shutters varies for different reasons. Generally, window shutters have a width of 12 inches to 18 inches; a length of up to six feet long, and a thickness of 0.75 inches to 1.5 inches.

It is desirable to develop and provide a shutter cover and/or a kit comprising the same for enhancing the visual representation of the shutter and/or the building structure associated therewith.

BRIEF DESCRIPTION

The present disclosure is directed, in various exemplary embodiments, to shutter covers for use on window shutters and kits including such shutter covers. The shutter cover allows the appearance of the window shutter to be reversibly changed.

In some embodiments, a shutter cover kit comprises an attachment member, a rectangular shutter cover, and at least one securing member. The attachment member comprises a back wall, a front wall, and a top wall located between the back wall and the front wall, the top wall comprising a first pile. The rectangular shutter cover has a top edge, a bottom edge, and a front display surface. The top edge comprises a second pile. The bottom edge comprises a pocket that contains a weighted member and is adapted so that the weighted member cannot be removed from the pocket. The bottom edge of the shutter cover further comprises a tab that extends from a side of the shutter cover and comprises a pile of hook elements or a pile of loop elements. The front display surface comprises a decorative or graphic display. The securing member comprises a dorsal wall, a ventral wall, and a bottom wall located between the dorsal wall and the ventral wall. Either (i) the first pile is a pile having loop elements and the second pile is a pile having hook elements; or (ii) the first pile is a pile having loop elements and the second pile is a pile having hook elements.

In other embodiments, a shutter cover kit comprises an attachment member and a shutter cover. The shutter cover has a top edge, a bottom edge, and a front display surface. The top edge comprises a means for affixing the shutter cover to the attachment member. The bottom edge comprises at least one means for securing the location of the shutter cover relative to an associated window shutter or an associated securing member.

The means for securing may be selected from the group consisting of a pocket adapted to contain an associated weighted member, an adhesive tab, a tab with a pile of hook elements, and a tab with a pile of loop elements.

In some embodiments, the pocket runs substantially along the width of the shutter cover. The pocket may also be adapted so that the weighted member cannot be removed from the pocket.

The means for affixing may comprise a pile selected from the group consisting of a pile having loop elements and a pile having hook elements. The means for affixing can also be a screw, rivet, magnet, or magnetically attracted substrate.

In additional embodiments, either (i) the means for affixing can comprise a pile having loop elements and the attachment member comprises a pile having hook elements; or (ii) the attachment member can comprise a pile having loop elements and the means for affixing comprises a pile having hook elements.

The attachment member may comprise a back wall, a front wall, and a top wall located between the back wall and the front wall.

In embodiments where the kit comprises the securing member, either (i) the means for securing can comprise a pile having loop elements and the securing member comprises a pile having hook elements; or (ii) the securing member can comprise a pile having loop elements and the means for securing comprises a pile having hook elements.

The securing member may comprise a dorsal wall, a ventral wall, and a bottom wall located between the dorsal wall and the ventral wall. In further embodiments, the bottom wall defines a containment distance; a grabbing distance is defined by the closest distance between the dorsal wall and the ventral wall measured parallel to the bottom wall; and the grabbing distance is less than the containment distance. In alternative embodiments, the ventral wall is shaped so that the point of the ventral wall which is furthest from the bottom wall is not the point of the ventral wall which is closest to the dorsal wall.

The shutter cover may be rectangular. The front display surface may include a decorative or graphic display. The shutter cover may also comprise a material selected from the group consisting of polyester, a woven fabric, a fused fabric, a plastic material, and a paper material.

In other embodiments, a shutter cover kit comprises: an attachment member; a shutter cover having a top edge, a bottom edge, and a front display surface, the top edge comprising a means for affixing the shutter cover to the attachment member; and a securing member for attaching the bottom edge of the shutter cover to an associated window shutter.

The attachment member may comprise a back wall, a front wall, and a top wall located between the back wall and the front wall, the top wall being adapted to attach to the means for affixing.

The securing member may comprise a dorsal wall, a ventral wall, and a bottom wall located between the dorsal wall and the ventral wall, wherein the ventral wall is shaped so that the point of the ventral wall which is furthest from the bottom wall is not the point of the ventral wall which is closest to the dorsal wall.

The bottom edge of the shutter cover may further comprise a pocket that contains a weighted member, the pocket being adapted so that the weighted member cannot be removed from the pocket. The bottom edge of the shutter cover may also comprise a tab extending from the side of the shutter cover.

In still other embodiments, a shutter cover kit comprises an attachment member and two shutter covers, each having a top edge, a bottom edge, and a front display surface, wherein the top edge comprises a means for affixing the shutter cover to the attachment member, the bottom edge comprises at least one means for securing the location of the shutter cover relative to an associated window shutter or an associated securing member, and the front display surface includes a graphic display thereon. The graphic display of one shutter cover may be the same as, or differ from, the graphic display of the other shutter cover.

In some embodiments, a method for decorating a building having window shutters is disclosed, comprising: providing a shutter cover; and attaching the shutter cover to the top of an associated window shutter so that the shutter cover at least partially covers the outer surface of the associated window shutter.

In other embodiments, a method for decorating a building having window shutters is disclosed, comprising: providing a shutter cover and an attachment member; attaching the attachment member to the top of an associated window shutter; and attaching the shutter cover to the attachment member so that the shutter cover at least partially covers the outer surface of the associated window shutter.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

A more complete understanding of the shutter cover system or kit can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the present disclosure. In particular, some components are defined in relative terms, e.g. "top," "bottom," "front," "back," etc. These relative terms are used for ease of description and should not be construed as limiting the components.

Figure 1:
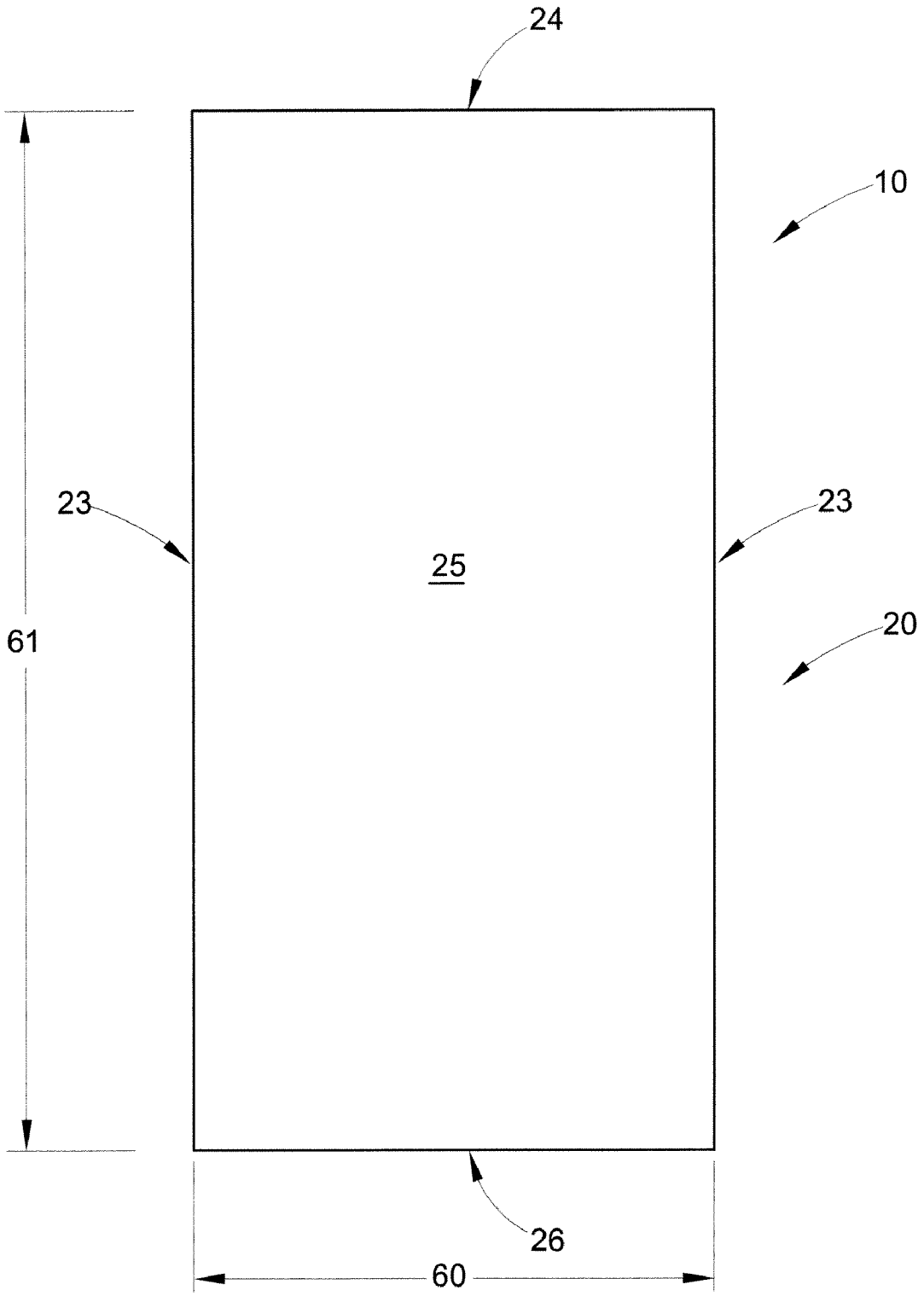
FIG. 1 is a front view of the shutter cover system of the present disclosure.

Referring to FIG. 1, the shutter cover system 10 comprises a shutter cover 20. The shutter cover 20 has a top edge 24, a bottom edge 26, and at least two side edges 23. The shutter cover can be of the desired shape, which may match, substantially match, at least partially surround, or at least partially cover the shape of the shutter or the window. For example, the window might be rectangular, angled, trapezoidal, arched, circular, oval, hexagonal, octagonal, etc. The shutter would then be one-half the shape of the window. Most windows and shutters are rectangular.

The shutter cover can be made from various types of materials. In one embodiment, the edges may be sewn with a quarter-inch baby hem around the entire perimeter. The dimensions of the shutter cover 20 will vary so as to fit the individual shutter and may be adjustable in length by cutting, sewing, folding, clipping, or using adhesives or otherwise shortening the bottom edge 26.

The shutter cover 20 may be made from fabrics and related materials (e.g. polyester, plastic sheeting, coated paper, woven fabrics, fused fabrics, etc.) that are preferably weather-resistant, tear-resistant, have a high UV rating, are strong, and/or have good colorfastness. The shutter cover can be transparent, semi-transparent, translucent, or solid.

The shutter cover 20 may have a graphic display of decorative patterns and/or text on at least a front display surface 25. It should be appreciated that essentially any type of visual decorative or artistic representation including particular color schemes, drawings, paintings, stencils, prints, ribbons, cutouts, designs, arrangements, etc can be included on the cover. For example, the graphic display may be based on holiday or seasonal themes. Similarly, the covers may include logos, trademarks, or other indicia from sports franchises or schools in the same community, such as CLEVELAND BROWNS, CLEVELAND INDIANS, CLEVELAND CAVALIERS, and THE OHIO STATE UNIVERSITY. In some embodiments, a decorative or graphic display may also be included on a rear display surface 27. This could be helpful for irregularly shaped windows that have shutters of different shapes.

In some embodiments, along the top edge 24, the shutter cover 20 further comprises a pocket 28 (see FIGS. 2 and 3) made by looping part of the material from which the cover is formed over itself and sewing it to an inside portion of the material. The seam which forms the pocket 28 should be double seamed for integrity. A rod may be inserted through the pocket 28. A graphic display, such as decorative designs and/or text, can be printed upon the front display surface 25 of the shutter cover 20.

In some specific embodiments, the shutter cover 20 has a width 60 of 15 inches, plus or minus a quarter-inch, and a length 61 of 74 inches after the pocket 28 is formed. In other specific embodiments, the pocket 28 has a height of 3 and one-half inches. In other embodiments, the shutter cover 20 has a length of from about 72 inches to about 76 inches.

Figure 2:
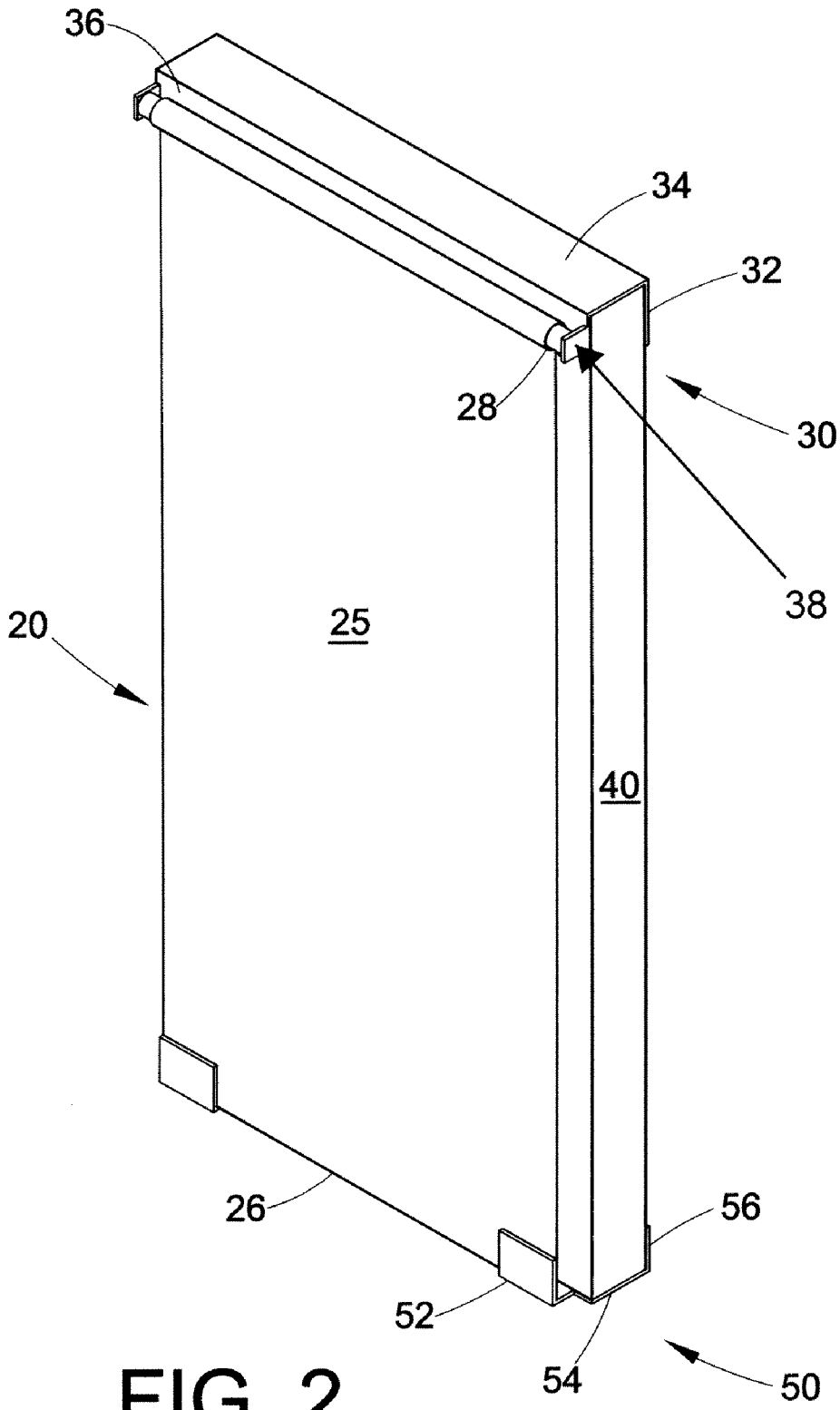
FIG. 2 is a perspective view of a first embodiment of the shutter cover system of the present disclosure.
Figure 3:
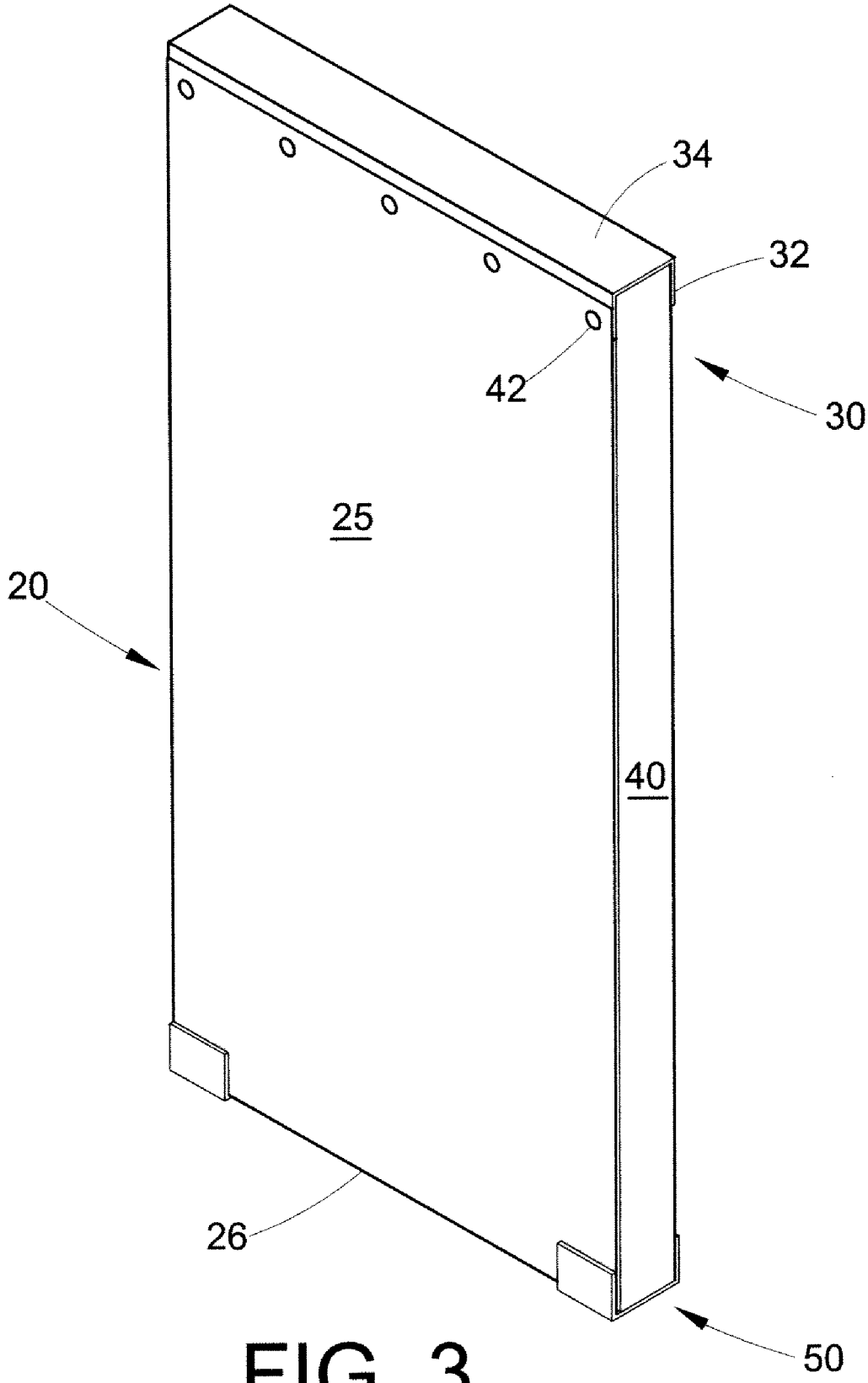
FIG. 3 is a perspective view of a second embodiment of the shutter cover system of the present disclosure.
Figure 4:
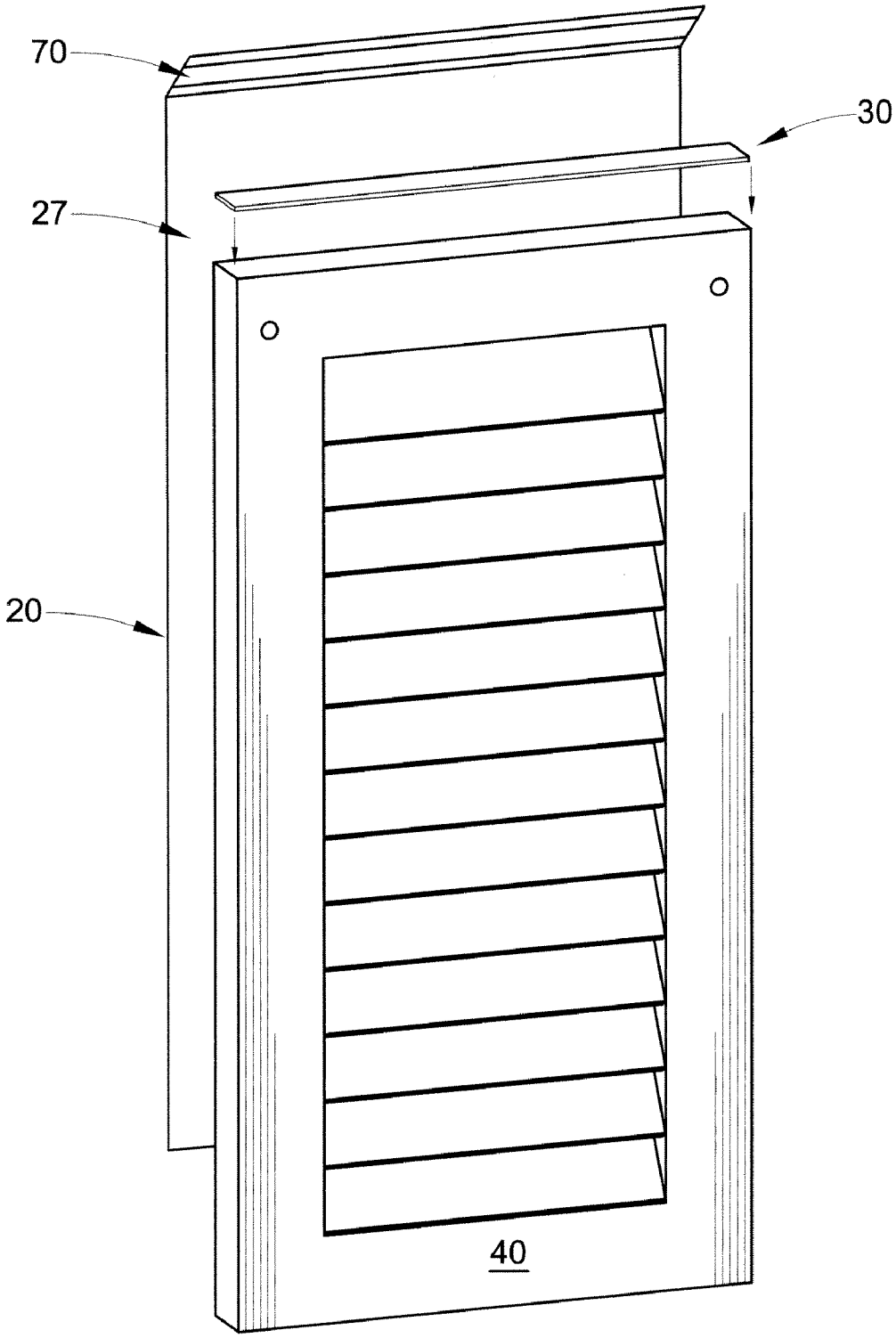
FIG. 4 is a view of another embodiment of the shutter cover kit of the present disclosure.

In other embodiments, as shown in FIG. 4, the top edge 24 comprises a means for affixing 70 the shutter cover 20 to an attachment member 30. The means for affixing 70 the shutter cover and the attachment member 30 may take several forms. Referring to FIGS. 2 and 3, the attachment member 30 generally has the shape of an upside-down U which fits over the top of associated window shutter 40. The front wall 36 of the attachment member 30 interacts with the pocket 28 of the shutter cover 20 so as to attach the shutter cover 20 to the window shutter 40. As seen in FIG. 2, the means for affixing 70 can be a rod which passes through the pocket 28 and is attached to the front wall 36 by side walls 38. As seen in FIG. 3, the shutter cover 20 is attached to the front wall 36 via screws or rivets 42, which serve as means for affixing 70. In this case, the pocket 28 is used as a double layer to strengthen the attachment. Alternatively, eyelets are formed along the top edge for putting the screws or rivets through. Alternately, the shutter cover 20 and the attachment member 30 can be glued to each other or sewed to each other. As shown in FIG. 4, the means for affixing 70 and the attachment member 30 together form a hook-and-loop system made from two engaging piles, one pile having loop elements and one pile having hook elements, that act together to form a separable bond. An exemplary hook-and-loop system is VELCRO™. The means for affixing 70 can be either the pile having loop elements or the pile having hook elements, and the attachment member 30 is the complementary pile. In these embodiments, the attachment member would be attached to the window shutter by, for example, adhesive on the back side of the complementary pile. The means for affixing 70 generally will not extend beyond the perimeter of the rectangular shutter cover. As another example, magnets may be used to separably join the shutter cover 20 and the attachment member 30. The means for affixing 70 can be either the magnet or the attracted substrate, and the attachment member 30 is the complement.

Figure 5:
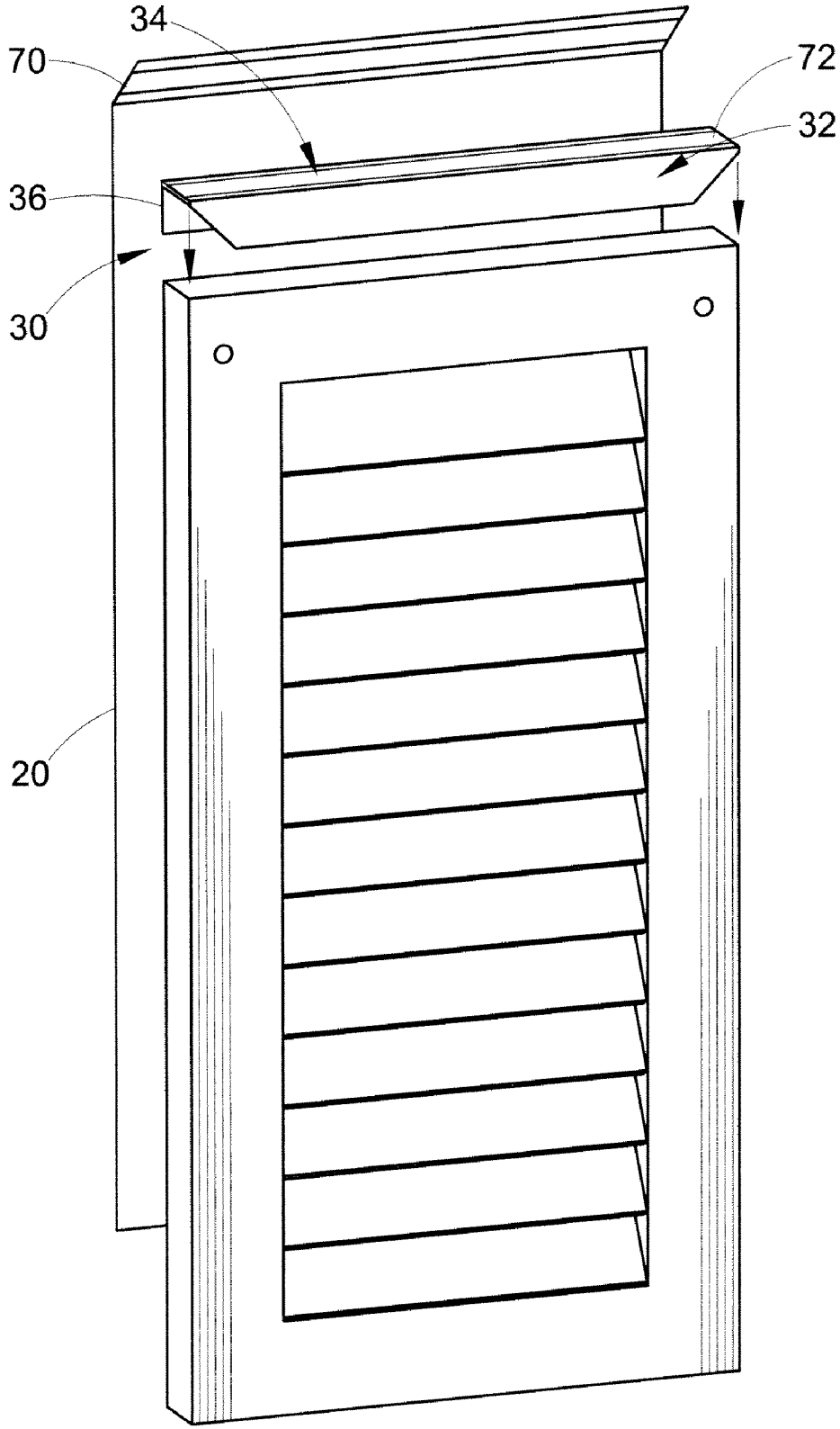
FIG. 5 is a view of another embodiment of the shutter cover kit of the present disclosure.

In other embodiments, as shown in FIG. 5, the attachment member 30 comprises a back wall 32, a top wall 34, and a front wall 36. The top wall is located between the back wall and the front wall. The complementary pile to the means for affixing 70 is shown here as reference numeral 72 attached to the top wall 34.

Figure 6A:
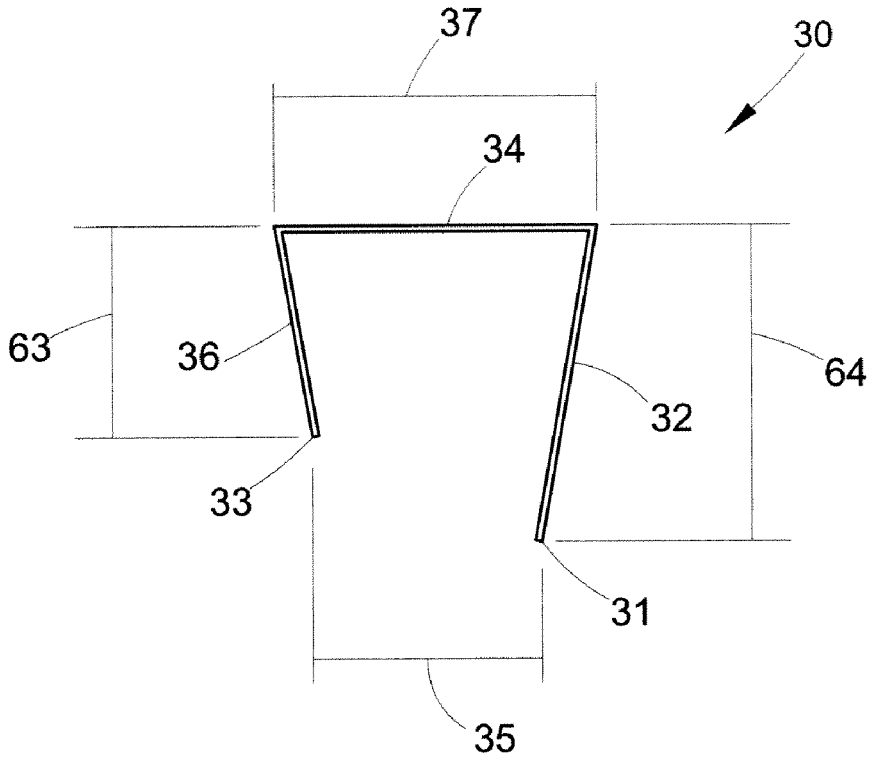
FIGS. 6A and 6B are side views of different attachment members useful in the shutter cover kit of the present disclosure.
Figure 6B:
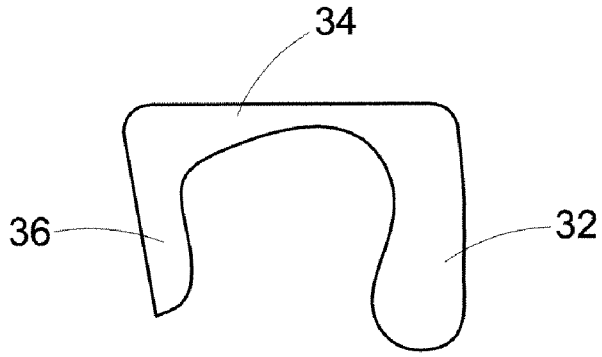

The attachment member 30 can vary in size so as to fit the associated window shutter 40. In specific embodiments, the attachment member is about 14 inches to about 16 inches in length (note that the length of the attachment member is along the same axis as the width of the shutter cover), including about 15 inches. The attachment member can be made of varying plastic materials and in particular can be made from poly(vinyl chloride) (PVC). FIGS. 6A and 6B are side views of different attachment members. The attachment member is desirably flexible to make it easy to install, then "grab" onto the top of the window shutter. If desired, the inner surfaces may be ridged to provide extra grip. As shown in FIG. 6A, for example, the front wall 36 and back wall 32 are bent so that their distal edges 31, 33 from the top wall 34 define a distance 35 that is less than the width 37 of the top wall 34. For example, width 37 may be about 1.5 inches, while distance 35 is about 0.75 inches. The front wall 36 and back wall 32 may also differ in height. For example, front wall 36 might have a height 63 of about one inch, while back wall 32 has a height 64 of about 1.25 inches. As shown in FIG. 6B, the inner and outer surfaces of each wall may also vary. Put another way, the thickness of each wall may vary.

Figure 7A:
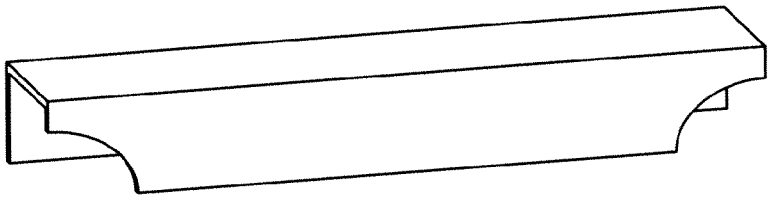
FIGS. 7A-7E are perspective views of different attachment members useful in the shutter cover kit of the present disclosure.
Figure 7B:
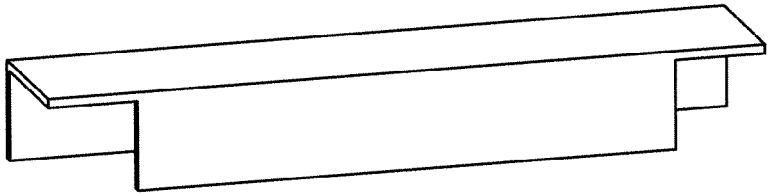
Figure 7C:
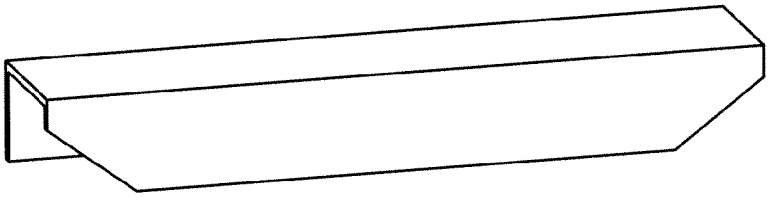
Figure 7D:
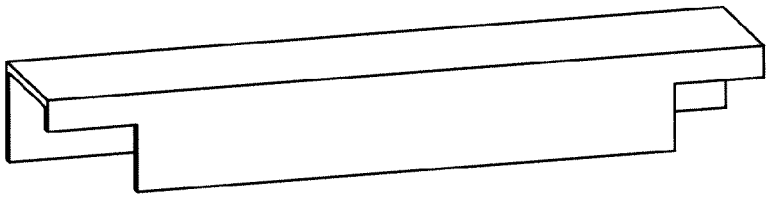
Figure 7E:
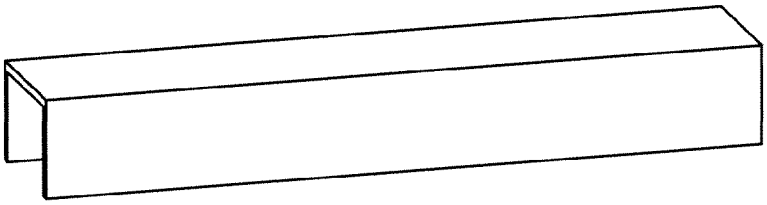

FIGS. 7A-7E are perspective views of different attachment members. As seen here, the walls of the attachment member may vary as well. The back wall 32 of FIGS. 7A-7D are "clipped", whereas the back wall of FIG. 7E is not. These different members may be useful for installing the attachment member if, for example, the window shutter is attached too tightly to the house, is chalked against the house, or has fasteners at inconvenient locations as illustrated in FIG. 5.

Figure 8:
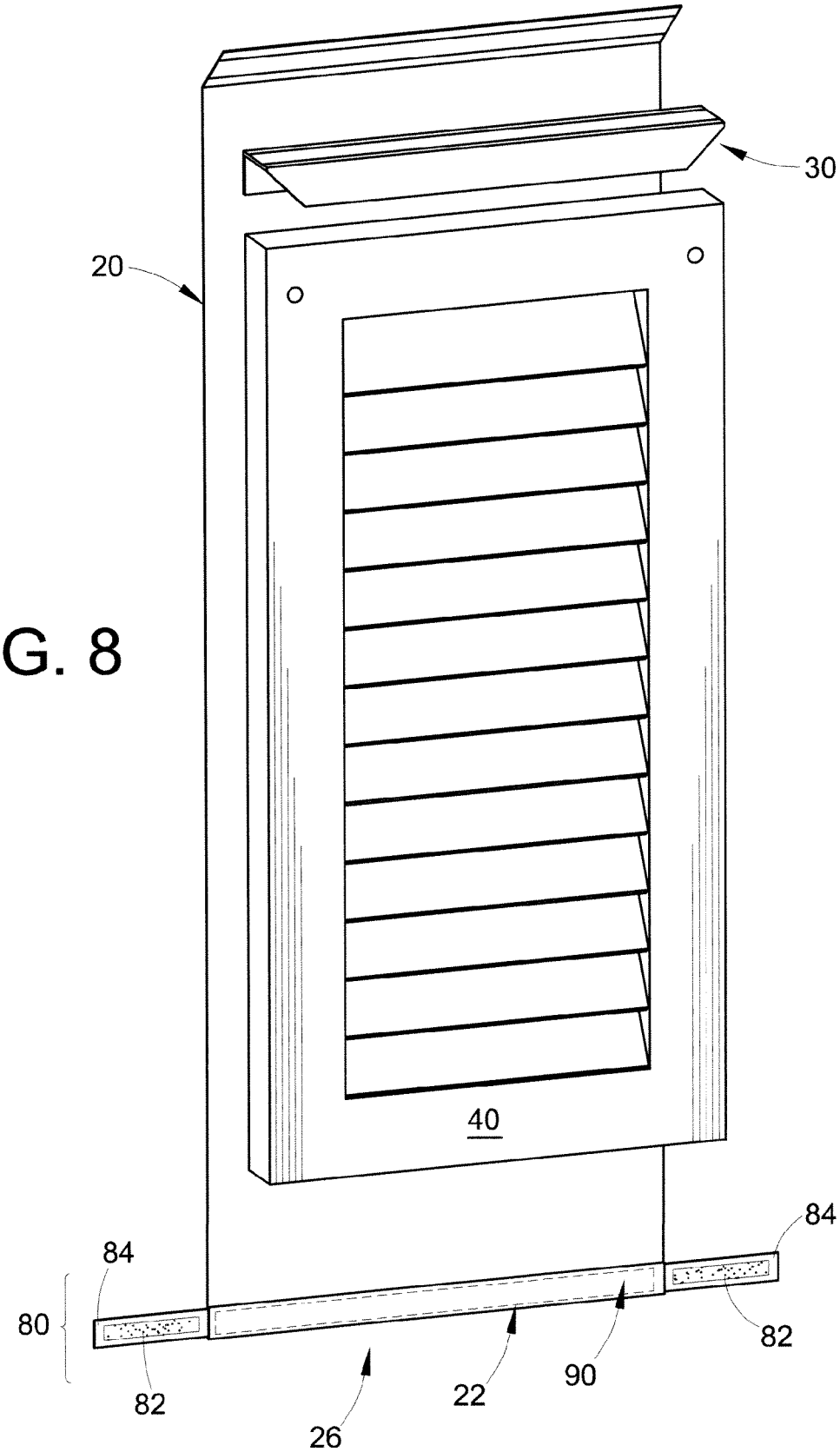
FIG. 8 is a view of another embodiment of the shutter cover kit of the present disclosure.

If desired, the bottom edge 26 of the shutter cover can further comprise a means for securing 80 the shutter cover to the window shutter or a securing member 50. For examples, as shown in FIG. 8, the bottom edge 26 of the shutter cover 20 can comprise a pocket 22 which is adapted to contain a weighted member 90. The pocket 22 can be made by, for example, stitching, and can have a size of, for example, about 0.25 inches. Inserting a weighted member keeps the shutter cover taut, can help prevent the shutter cover from being blown about by high winds, and possibly prevents the need to use additional equipment to secure the bottom of the shutter cover to the window shutter. The pocket may run substantially along the width of the shutter cover 20, including the entire width. Alternatively, multiple pockets could be made. The pocket(s) may be made so that the weighted member can be removed, or the weighted member may be sewn into the pocket (i.e. cannot be removed).

Figure 9:
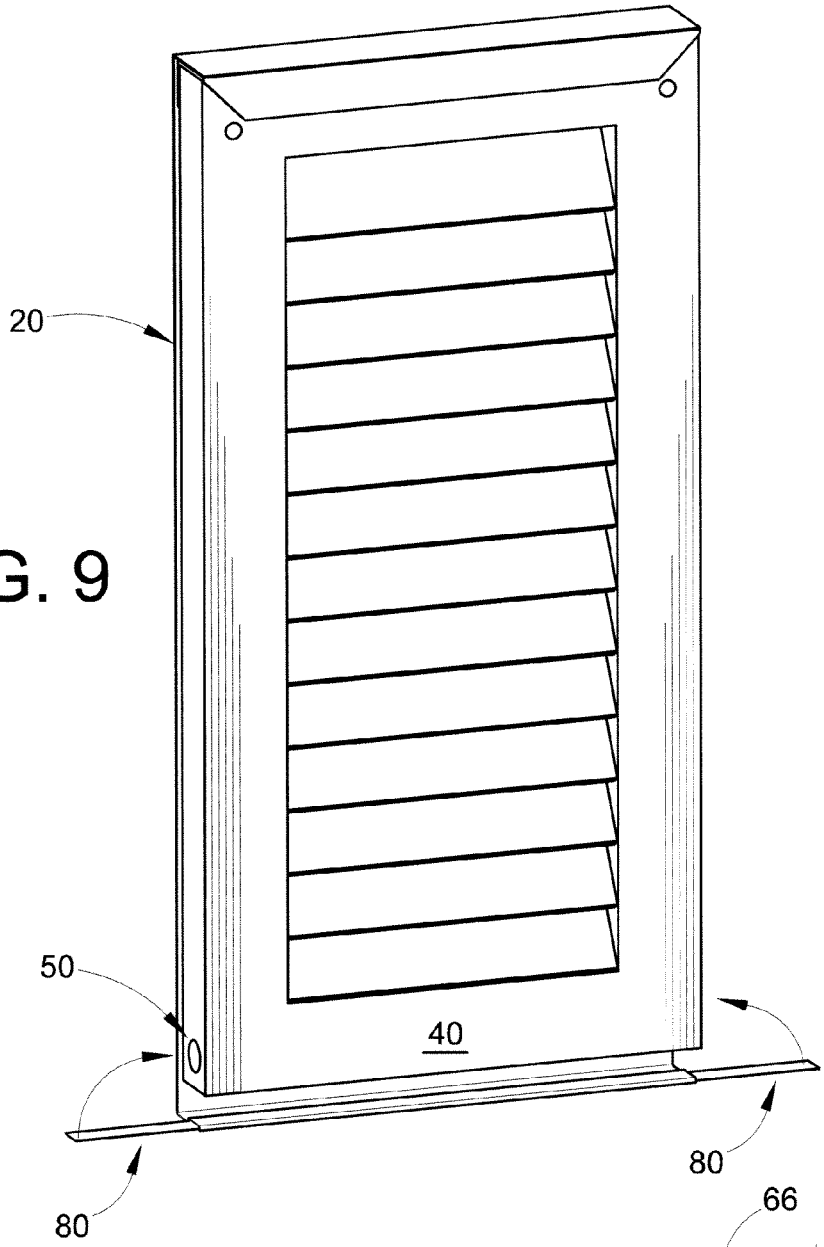
FIG. 9 is a view of another embodiment of the shutter cover kit of the present disclosure.

Also as shown in FIG. 8, the means for securing 80 can be adhesive dots 82 attached to tabs 84 extending from the side along the bottom edge 26, i.e. an adhesive tab. In these embodiments, no securing member needs to be affixed to the window shutter. The tab(s) may be about 3 inches long. As another example, as shown in FIG. 9, the means for securing 80 and the securing member 50 is another hook-and-loop system using the tab. The means for securing 80 can be a tab having either the pile having loop elements or the pile having hook elements, and the securing member 50 is the complementary pile. Again, the securing member would be attached to the window shutter by, for example, adhesive on the back side of the complementary pile.

Figure 10:
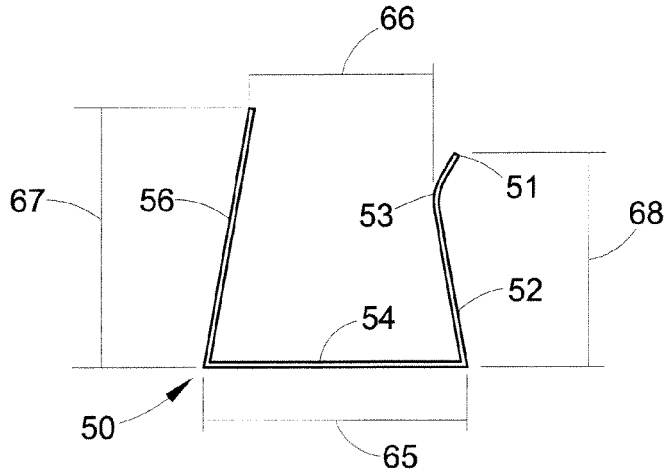
FIG. 10 is a side view of a securing member useful in the shutter cover kit of the present disclosure.

The bottom edge 26 can hang freely or be secured to the bottom of the associated window shutter 40. In FIGS. 2 and 3, the bottom edge 26 is secured by means of a bottom clip as securing member 50 included in the window shutter kit. The securing member 50 may also comprise a ventral wall 52, bottom wall 54, and dorsal wall 56. The bottom wall is located between the ventral wall and the dorsal wall, as seen in the side view of FIG. 10. The securing member 50 generally traps the shutter cover 20 between a ventral wall 52 of the securing member and the associated window shutter 40. Put another way, the shutter cover 20 and associated window shutter 40 are "grabbed" by the ventral wall 52 and the dorsal wall 56. Referring again to FIG. 10, the securing member 50 can be thought of as defining a volume that contains the window shutter and the shutter cover. The bottom wall 54 defines a containment distance 65. A grabbing distance 66 is defined by the closest distance between the dorsal wall and the ventral wall measured parallel to the bottom wall. The grabbing distance is less than the containment distance. In some embodiments, the ventral wall is shaped so that the point of the ventral wall 51 which is furthest from the bottom wall 54 is not the point of the ventral wall 53 which is closest to the dorsal wall 56. This design allows the securing member to be more easily removed by the end-user. For example, grabbing distance 66 may be about 0.75 inches, while confinement distance 65 is about 1.5 inches. The ventral wall 52 and dorsal wall 56 may also differ in height. For example, ventral wall 52 might have a height 68 of about one inch, while dorsal wall 56 has a height 67 of about 1.25 inches.

As shown in FIGS. 8 and 9, some embodiments of the shutter cover 20 have multiple means for securing along the bottom edge. For example, the shutter cover may have (i) a pocket for containing a weighted member and (ii) tabs with a pile on them. The corresponding shutter cover kit may therefore include multiple types of securing members. For example, a shutter cover kit can have a first securing member which is a bottom clip as shown in FIG. 2 and a second securing member which is a complementary pile as shown in FIG. 9.

As shown in FIGS. 8 and 9, the shutter cover can be "rolled up" to match the height of the window shutter that is being decorated. The securing member 50 or means for securing 80 still function for their purpose of fixing the shutter cover relative to the window shutter.

The securing member 50 can also be made from various plastic materials (such as PVC) and have varying dimensions. The securing member 50 is desirably transparent. They may have a length of about 2 inches. A plurality of securing members can be included in the kit. Unlike the attachment member, it is better to use multiple short securing members because they will not be pulled off by their own weight.

The shutter cover 20 and attachment member 30 may be integrally attached to each other as sold to the end-user or may be assembled together by the end-user. The shutter cover kit can include the shutter cover 20, attachment member 30, and/or securing member 50, in varying numbers as well. For example, a shutter cover kit may include two shutter covers, two attachment members, and two or four securing members.

Several specific embodiments of shutter cover kits are contemplated. In some embodiments, the shutter cover kit comprises a rectangular shutter cover, an attachment member, and at least one securing member. The shutter cover comprises a first pile along the top edge. The bottom edge of the shutter cover comprises a pocket containing a weighted member sewn into it and a tab having a pile upon it. The attachment member has three walls and a second pile on the top wall. The first pile and second pile are complementary and together form a hook-and-loop system. The pile on the tab can comprise either hook elements or pile elements. The securing member comprises a dorsal wall, a ventral wall, and a bottom wall located between the dorsal wall and the ventral wall. The kit may further comprise a second securing member, which is a pile complementary to the pile on the tab.

In other embodiments, the shutter cover kit comprises a rectangular shutter cover and an attachment member. The shutter cover comprises a means for affixing the shutter cover to an associated attachment member and a pocket for a weighted member. A securing member is not necessarily needed for these embodiments because the weighted member generally fixes the position of the shutter cover on the bottom. The kit may further comprise the weighted member.

In other embodiments, the shutter cover kit comprises a rectangular shutter cover and an attachment member. The shutter cover comprises a means for affixing the shutter cover to an associated attachment member and tabs along the bottom edge for attaching the shutter cover to an associated window shutter. A securing member and weighted member is not necessarily needed for these embodiments because the tabs generally fix the position of the shutter cover on the bottom.

In other embodiments, the shutter cover kit comprises a rectangular shutter cover, an attachment member, a weighted member, and at least one securing member. The shutter cover comprises a means for affixing the shutter cover to an associated attachment member. The securing member is used to secure the bottom edge of the shutter cover.

In other embodiments, the shutter cover kit comprises a rectangular shutter cover, an attachment member, a weighted member, and at least one securing member. The shutter cover comprises a means for affixing the shutter cover to an associated attachment member along the top edge and a pocket for the weighted member along the bottom edge.

In other embodiments, the shutter cover kit comprises two rectangular shutter covers, two attachment members, and a plurality of securing members. The shutter cover, attachment member, and securing member may be as described above.

Figure 11:
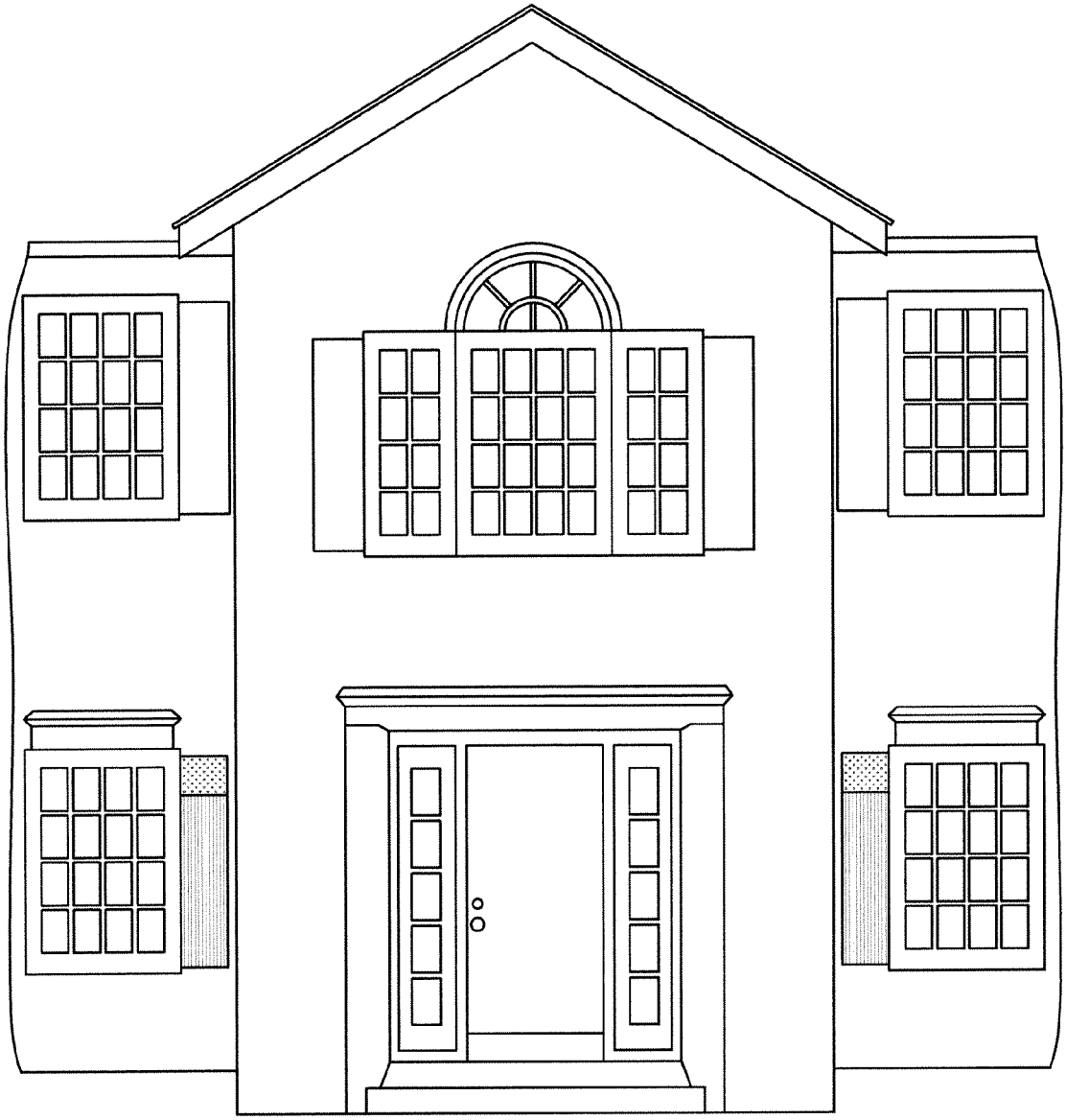
FIG. 11 is a view of the shutter cover system applied to a house.
Figure 12:
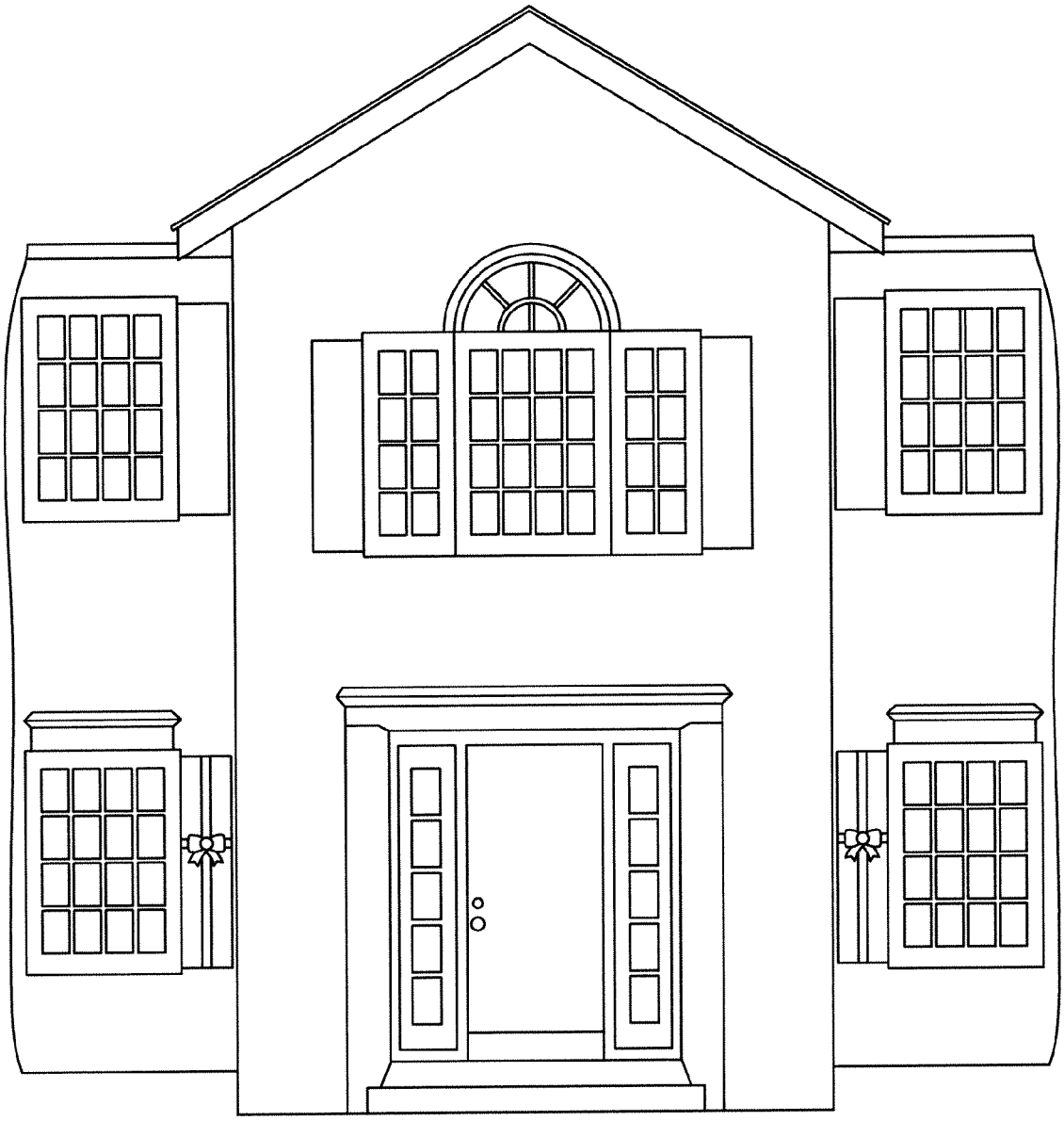
FIG. 12 is a second view of the shutter cover system applied to a house.

The shutter cover system or kit may be used or applied to shutters on any building, such as a house. It provides a simple and easy way to decorate the building or house. Any decorative design can be printed on the shutter cover and used. A number of non-limiting examples are shown in FIGS. 11 and 12. In these figures, the upstairs windows have shutters that are not decorated, while the downstairs windows have shutters that are covered by the shutter covers of the present disclosure.

In FIG. 11, the shutter cover has a patriotic American theme. These two prints would be appropriate for holidays, such as Memorial Day and/or Independence Day, or for simply reflecting national pride.

In FIG. 12, the shutter cover has a decorative print resembling a present wrapped up in ribbons and a bow. Such a print is useful during Christmas for a more festive appearance.

The decorative shutter cover kit may further include a plurality of interchangeable covers for at least partially surrounding the outer surface of the cover. The additional interchangeable covers may be similar in all aspects except for the graphic display depicted thereon. For example, the decorative shutter cover kit can have interchangeable covers reflective of different seasons, holidays, athletic seasons, etc.

Other types of decoration for the graphic display of the shutter cover are also contemplated. For example, glow-in-the-dark or iridescent ink, paint, or applique could be incorporated. Light-emitting diodes (LEDs) or other lights might be used. Metallic or fiber-optic materials could also be incorporated. A pop-out object might extend from the shutter cover. Separable bonding systems, such as VELCRO™, might be placed on the shutter cover to allow items to be moved around as desired by the end-user or consumer. Sensors, such as motion sensors or noise sensors, could be included to trigger certain events, such as spooky noises, upon detection of people in proximity, such as Halloween trick-or-treaters. Additional equipment, such as a power supply (battery or solar), could be included in the shutter cover kit for such embodiments.

The shutter cover kit can be installed by affixing the attachment member to the top of the window shutter. If the shutter is chalked or too tightly attached to the structure, the attachment member will simply not extend behind the window shutter. The shutter cover is then attached to the attachment member. The bottom of the shutter cover is rolled up if necessary to match the height of the window shutter and secured to the window shutter, either using the means for securing or by using the securing member.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A method for decorating an associated window shutter on a house, comprising:

affixing an attachment member to a top of the associated window shutter, wherein the attachment member comprises a top wall having a front edge and a back edge, a back wall extending downward from the back edge, a front wall extending downward from the front edge, the front wall and back wall having different heights;

attaching a shutter cover to the top wall of the attachment member, wherein the shutter cover is rectangular and has a top edge, a bottom edge, two side edges, a front display surface, and a graphic display on the front display surface, the shutter cover is sized to completely cover a front surface of the associated window shutter, and the top edge of the shutter cover is attached to the top wall of the attachment member such that the front wall of the attachment member is covered by the shutter cover; and securing the bottom edge of the shutter cover to a bottom of the window shutter using a securing member so that the shutter cover completely covers the front surface of the associated window shutter, wherein the securing member comprises a bottom wall having a dorsal edge and a ventral edge, a dorsal wall extending upward from the dorsal edge, and a ventral wall extending upward from the dorsal edge, the dorsal wall and ventral wall having different heights.

2. A shutter cover kit consisting of:

a flexible attachment member that fits over the top of an associated window shutter, consisting of a top wall having a front edge and a back edge, a back wall extending downward from the back edge, a front wall extending downward from the front edge, the front wall and back wall having different heights, and a first pile on an upper surface of the top wall that is exposed when the attachment member is fitted on the associated window shutter;

a rectangular shutter cover having a top edge, a bottom edge, two side edges, a front display surface, and a graphic display on the front display surface, the shutter cover being sized to completely cover a front surface of the associated window shutter, and a second pile on the top edge of the shutter cover; and at least one securing member for attaching the bottom edge of the shutter cover to the associated window shutter, comprising a bottom wall having a dorsal edge and a ventral edge, a dorsal wall extending upward from the dorsal edge, and a ventral wall extending upward from the dorsal edge, the dorsal wall and ventral wall having different heights;

wherein the first pile and the second pile can be joined to affix the top edge of the shutter cover to the top wall of the attachment member such that the front wall of the attachment member is covered by the shutter cover.

3. The shutter cover kit of claim 2, wherein the shutter cover comprises a material selected from the group consisting of polyester, a woven fabric, a fused fabric, a plastic material, and a paper material.

4. The shutter cover kit of claim 2, wherein (i) the first pile is a pile having loop elements and the second pile is a pile having hook elements; or (ii) the first pile is a pile having hook elements and the second pile is a pile having loop elements.

5. A shutter cover kit comprising:

a flexible attachment member that fits over the top of an associated window shutter, comprising a top wall having a front edge and a back edge, a back wall extending downward from the back edge, and a front wall extending downward from the back edge;

a rectangular shutter cover having a top edge, a bottom edge, two side edges, a front display surface, and a graphic display on the front display surface, the shutter cover having a width of 14.75 inches to 15.25 inches and a length of from about 72 inches to about 76 inches, and the top edge of the shutter cover being affixed to the attachment member such that the front wall of the attachment member is covered by the shutter cover; and a securing member for attaching the bottom edge of the shutter cover to the associated window shutter, comprising a bottom wall having a dorsal edge and a ventral edge, a dorsal wall extending upward from the dorsal edge, and a ventral wall extending upward from the dorsal edge;

wherein the bottom wall defines a containment distance, a grabbing distance is defined by the closest distance between the dorsal wall and the ventral wall measured parallel to the bottom wall, and the grabbing distance is less than the containment distance wherein the ventral wall is shaped so that the point of the ventral wall which is furthest from the bottom wall is not the point of the ventral wall which is closest to the dorsal wall.

6. The shutter cover kit of claim 5, wherein the shutter cover comprises a material selected from the group consisting of polyester, a woven fabric, a fused fabric, a plastic material, and a paper material.

7. The shutter cover kit of claim 5, wherein (i) the top edge of the shutter cover includes a pile having loop elements and the top wall of the attachment member includes a pile having hook elements; or (ii) the top edge of the shutter cover includes a pile having hook elements and the top wall of the attachment member includes a pile having loop elements;

wherein the pile having loop elements and the pile having hook elements are joined to affix the top edge of the shutter cover to the attachment member.

* * * * *